United States Patent [19]

Hashiguchi et al.

[11] Patent Number: 5,073,125

[45] Date of Patent: Dec. 17, 1991

[54] ELECTRICAL CONNECTOR COMPRISING AN INTERMEDIATE CONNECTION ELEMENT FOR CONNECTING AND DISCONNECTING BETWEEN A FIRST AND SECOND CONNECTION ELEMENT

[75] Inventors: Osamu Hashiguchi; Yukiharu Tayama; Shigeharu Yamamura, all of Tokyo, Japan

[73] Assignees: Japan Aviation Electronics Industry, Limited; NEC Corporation, both of Tokyo, Japan

[21] Appl. No.: 505,788

[22] Filed: Apr. 6, 1990

[30] Foreign Application Priority Data

Apr. 7, 1989 [JP] Japan ..... 1-40459[U]
Apr. 7, 1989 [JP] Japan ..... 1-40460[U]

[51] Int. Cl.[5] ..... H01R 13/62
[52] U.S. Cl. ..... 439/310; 439/259
[58] Field of Search ..... 439/65, 79, 80, 131, 439/310, 259, 265, 266, 269, 270, 347

[56] References Cited

U.S. PATENT DOCUMENTS 3,320,572 5/1967 Schwartz ..... 439/80
4,352,533 10/1982 Murase et al. ..... 439/310 X
4,392,700 7/1983 Showman et al. ..... 439/310 X
4,900,258 2/1990 Hnatuck et al. ..... 439/65 X

FOREIGN PATENT DOCUMENTS 2833624 3/1979 Fed. Rep. of Germany ..... 439/131

*Primary Examiner*—Neil Abrams
*Assistant Examiner*—Khiem Nguyen
*Attorney, Agent, or Firm*—Laff, Whitesel, Conte & Saret

[57] ABSTRACT

For carrying out electrical connection or disconnection between a first and a second contact which are electrically connected to electric circuits, respectively, an electrical connector comprises a connecting member of a pin type. The first and the second contacts have a first and a second socket portion, respectively, and are arranged in a common axis so that the first socket portion faces the second socket portion in a predetermined direction. The connecting member is closely fitted in the first socket portion to be movable in the predetermined direction. When the connecting member is moved in the predetermined direction to closely fit into the second socket portion, the first and the second conductive contacts are electrically connected to each other through the connecting member. It is possible to disconnect the first contact from the second contact by moving the connecting member reversely.

15 Claims, 11 Drawing Sheets

ELECTRICAL CONNECTOR COMPRISING AN INTERMEDIATE CONNECTION ELEMENT FOR CONNECTING AND DISCONNECTING BETWEEN A FIRST AND SECOND CONNECTION ELEMENT

BACKGROUND OF THE INVENTION

This invention relates to an electrical connector which is useful in switching connection or disconnection of electric circuits.

Various electrical connectors of the type are already known. For example, an electrical connector is disclosed in J-P-B2 No. 57-27592 for use in a conventional communication unit which comprises a distributing board and a circuit board. The electrical connector comprises a first, a second, and a third connection element as will presently be described.

The first connection element comprises a first insulator and a first conductive contact tightly held to the first insulator. Similarly, the second connection element comprises a second insulator and a second conductive contact tightly held to the second insulator. Each of the first and the second conductive contact is of a pin type. The first and the second insulators are fixedly placed to each other to make the first conductive contact have an axial end thereof which is opposite to that of the second conductive contact in a predetermined direction. For example, the first and the second insulators are fixed to the distributing and the circuit boards, respectively.

The third connection element comprises a connecting member which is mounted on the first conductive contact to be movable in the predetermined direction. The connecting member has both ends which are formed with a first and a second socket portion in the manner known in the art, respectively. The first socket portion is always brought in contact with the first conductive contact. The second socket portion comes in contact with the second conductive contact by moving the connecting member.

When the connecting member is moved towards the second connection element in the predetermined direction, the second socket portion comes in contact with the second conductive contact together with the first socket portion being in contact with the first conductive contact. As a result, the first conductive contact is electrically connected to the second conductive contact through the connecting member.

According to the electric connector, it is possible to connect or disconnect the first conductive contact with the second conductive contact without removing the first and the second connection elements from the distributing and the circuit boards.

However, it is disadvantageous that the connector has a size which is relatively large in the predetermined direction. This is because the third connection element are formed with the first and the second socket portions at the both ends thereof.

SUMMARY OF THE INVENTION

It is therefore an object of the present invention to provide an electrical connector of the type described, which can be made in a small size in a predetermined direction, namely, a connection and disconnection direction.

Other objects of this invention will become clear as the description proceeds.

According to this invention, there is provided an electrical connector comprising a first, a second, and a third connection element. The first connection element comprises a first conductive contact of a socket type. The second connection element comprises a second conductive contact of a socket type facing the first conductive contact in a predetermined direction. The third connection element comprises a connecting member of a pin type closely fitted in the first conductive contact. The connecting member is movable in the predetermined direction for electrically connecting the first conductive contact to the second conductive contact with the connecting member closely fitted into the second conductive contact.

DESCRIPTION OF THE PREFERRED EMBODIMENTS

Description will be made at first about an electrical connector according to a first embodiment of this invention.

Although the electrical connector is for carrying out a plurality of coaxial connections and a plurality of uniaxial connections, the description will be made about one of the coaxial connections and one of uniaxial connections for a better understanding of the present invention.

Figure 1:
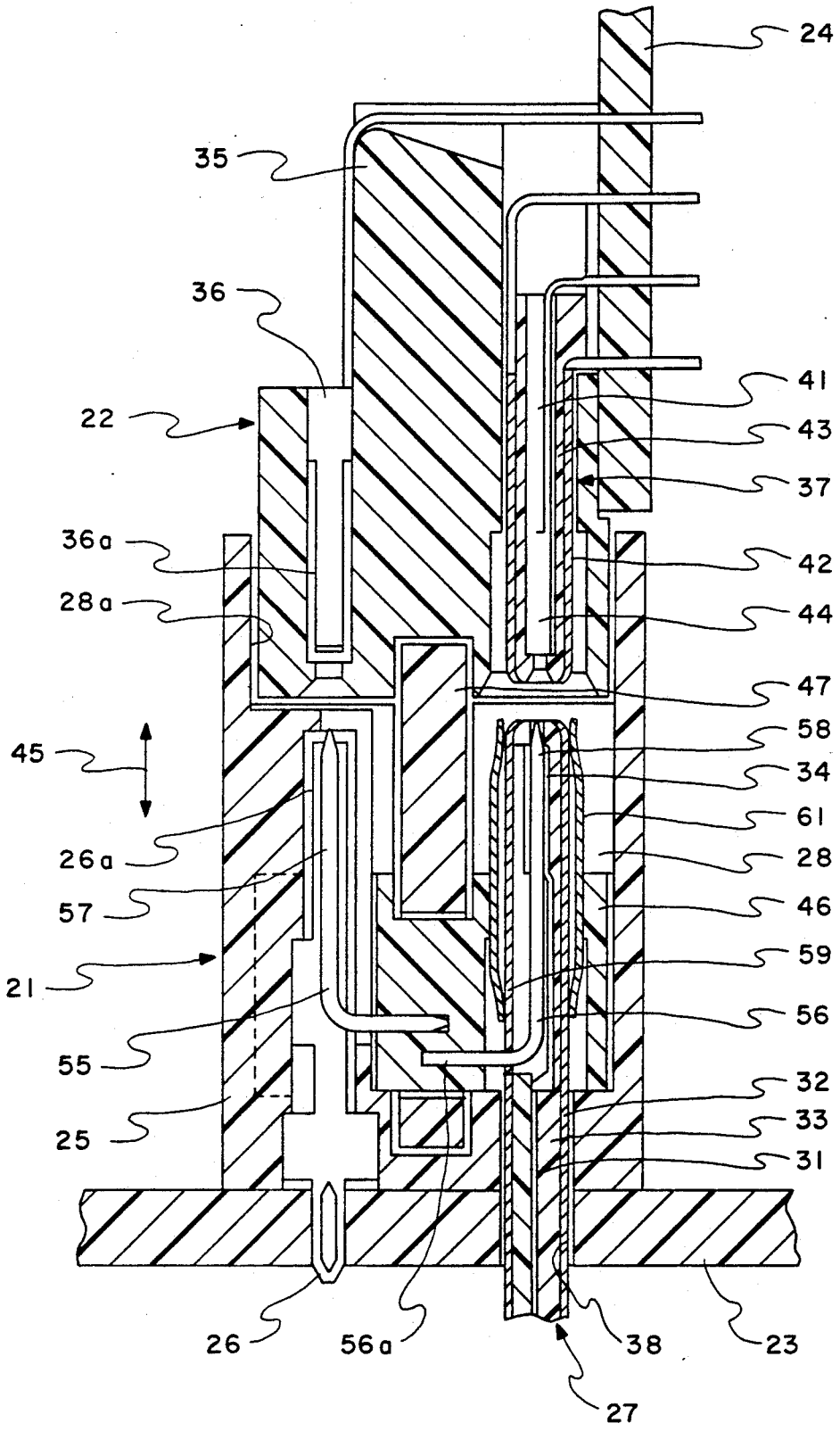
FIG. 1 is a sectional view of an electrical connector according to a first embodiment of this invention.
Figure 2:
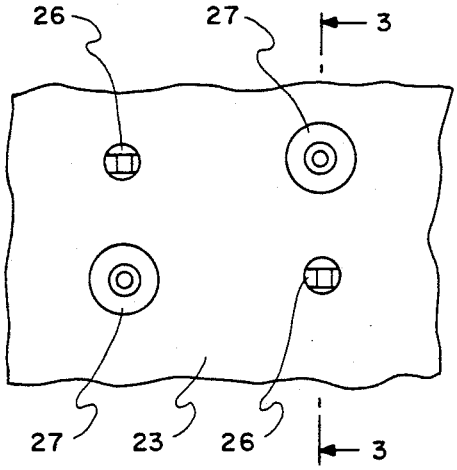
FIG. 2 is a bottom view of a main part of the electrical connector of FIG. 1.
Figure 3:
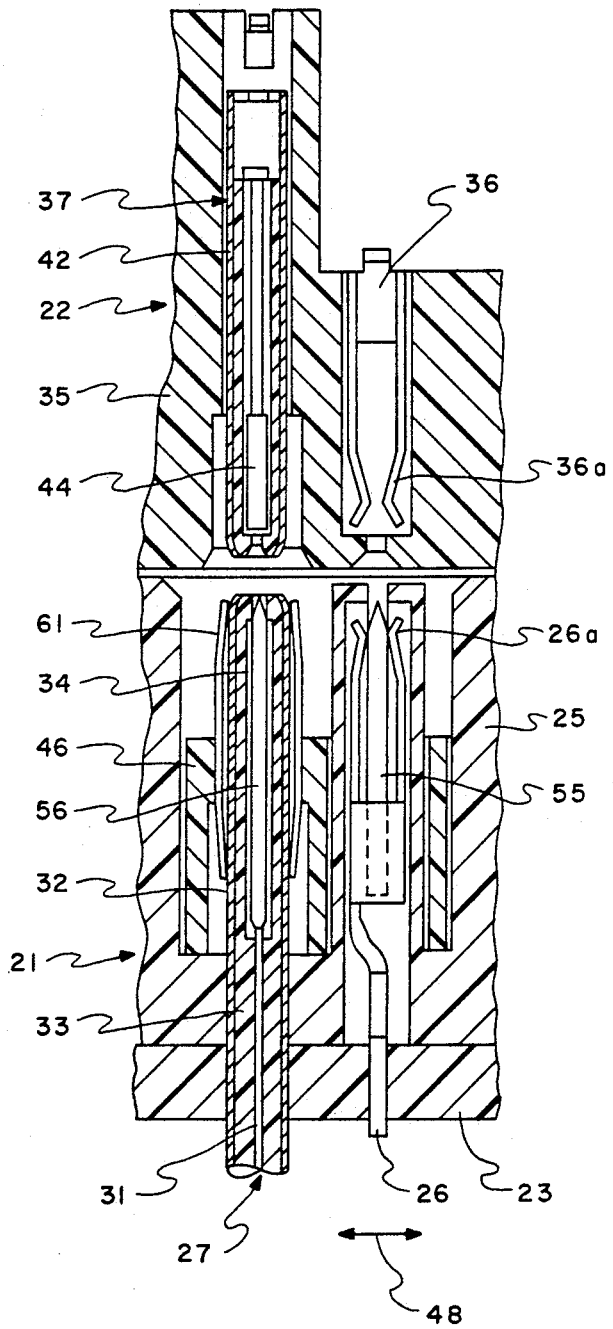
FIG. 3 is a sectional view of the electrical connector taken along a line 3—3 in FIG. 2.

Referring to FIGS. 1 through 3, the electrical connector comprises first and second connection elements 21 and 22. The first connection element 21 is mounted on a circuit board 23 extending along a first, for example, horizontal plane. The second connection element 22 is mounted on a distributing board 24 extending along a second, for example, vertical plane which is perpendicular to the first plane. Each of the circuit and the distributing boards 23 and 24 may be a printed circuit board which is known in the art.

The first connection element 21 comprises a first insulator 25, a first conductive contact 26, and a first coaxial contact 27. The first insulator 25 is made with a recessed portion 28 having an opening at an upper end thereof. The first conductive and the first coaxial contacts 26 and 27 are held to the first insulator 25. The first conductive contact 26 is mechanically fixed to the circuit board 23 and is electrically connected to a first electric circuit which is mounted on the circuit board 23. The first conductive contact 26 has a first contact portion 26*a* of a socket type at an upper portion thereof.

The first coaxial contact 27 comprises first inner and first outer conductors 31 and 32 which are insulated from one another by a first internal insulator 33. The first inner conductor 31 has a first socket portion 34 and may therefore be referred to herein as a first conductive contact. The first outer conductor 32 is cylindrical. The first inner and the first outer conductors 31 and 32 are led through a through hole 38 formed in the printed circuit board 23 and extends downwardly from the circuit board 23.

The second connection element 22 comprises a second insulator 35, a second conductive contact 36, and a second coaxial contact 37. The second insulator 35 is fitted in an upper part 28*a* of the recessed portion 28 of the first insulator 25. The second conductive and the second coaxial contacts 36 and 37 are held to the second insulator 35. The second conductive contact 36 is mechanically fixed to the distributing board 24 and is electrically connected to a second electric circuit which is mounted on the distributing board 24. The second conductive socket contact 36 has a second contact portion 36*a* of a socket type at a lower portion thereof.

The second coaxial contact 37 comprises second inner and second outer conductors 41 and 42 which are insulated from one another by a second internal insulator 43. The second inner conductor 41 has a second socket portion 44 and may therefore be referred to herein as a second conductive contact. The second outer conductor 42 is cylindrical. The second inner and the second outer conductors 41 and 42 are mechanically fixed to the distributing board 24 and is electrically connected to the second electric circuit.

The first and the second conductive contacts 26 and 36 are placed to have a first common axis extending in the predetermined direction 45. In other words, the first contact portion 26*a* of the first conductive contact 26 faces the second contact portion 36*a* of the second conductive contact 36 in a predetermined direction 45.

The first and the second coaxial contacts 27 and 37 are placed to have a second common axis extending in the predetermined direction 45. In other words, the first socket portion 34 of the first inner conductor 31 faces the second socket portion 44 of the second inner conductor 41 in the predetermined direction.

A movable insulator 46 and a slider plate 47 are placed in the recessed portion 28 of the first insulator 25. The movable insulator 46 is movable in the predetermined direction 45. The slider plate 47 is movable in a particular direction 48 which is perpendicular to the predetermined direction 45. As will later be clear, the movable insulator 46 is moved in the predetermined direction 45 dependent on movement of the slider plate 47 in the particular direction 48.

Figure 4:
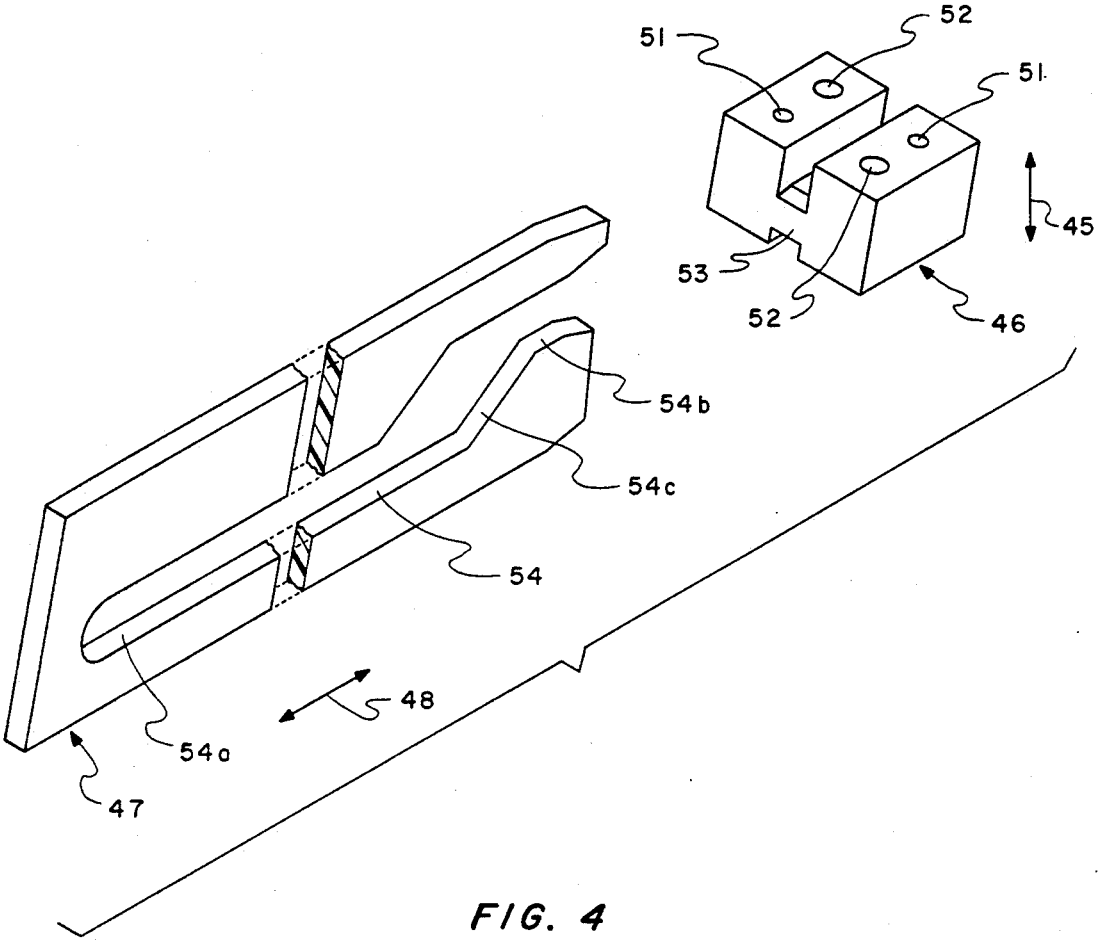
FIG. 4 is a perspective view of a movable insulator and a slider plate which are included in the electrical connector of FIG. 1.

Referring to FIG. 4 together with FIGS. 1 through 3, the movable insulator 46 has through holes 51 and 52 for receiving the first conductive and the first coaxial contacts 26 and 27, respectively, and a cam follower portion 53. The slider plate 47 has cam surfaces defining a slit 54 therebetween for receiving the cam follower portion 53 and is guided in the particular direction 48 by the first and the second insulators 25 and 35. The slit 54 has first and second portions 54*a* and 54*b* extending in the particular direction 48 but offset each other, and a third or an offset portion 54*c* extending slantingly to connect the first portion 54*a* with the second portion 54*b*.

Referring to FIGS. 1 through 3 again, first and second connecting members 55 and 56 are held to the movable insulator 46. The first connecting member 55 is of a pin type and comprises a first contact portion 57 which extends in the predetermined direction 45 and which is in contact with the first contact portion 26*a* of the first conductive contact 26. The first contact portion 57 are adapted to closely fit in the second contact portion 36*a* of the second conductive contact 36.

Figure 5:
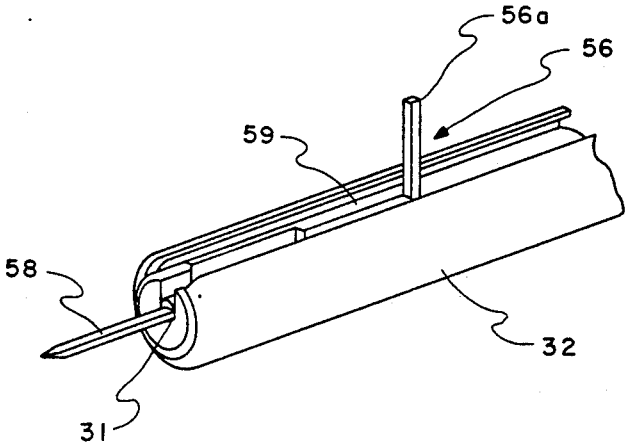
FIG. 5 is a perspective view of a first coaxial contact included in the electrical connector of FIG. 1.

Referring to FIG. 5 together with FIGS. 1 through 3, the second connecting member 56 is of a pin type and comprises a second contact portion 58 being in contact with the first socket portion 34 of the first inner conductor 31 inside the first outer conductor 32. The first outer conductor 32 of the first coaxial contact 27 has a slit 59 extending in the predetermined direction. The second connecting member 56 is led out from the first outer conductor 32 through the slit 59 to form a lead-out portion 56*a*. The lead-out portion 56*a* is held by the movable insulator 46.

The second contact portion 58 extends in the predetermined direction 45 through the first socket portion 34. The second contact portion 58 is adapted to closely fit in the second socket portion 44 of the second inner conductor 41. A combination of the movable insulator 46, the first connecting member 55, and the second connecting member 56 will be referred to herein as a third connection element.

In addition, the movable insulator 46 holds a cylindrical member 61 which is closely fitted on the first outer conductor 32. The cylindrical member 61 is of a conductive material and is adapted to closely fit on the second outer conductor 42 as will later be clear. The cylindrical member 61 is referred to as an additional connecting member.

According to this construction, a space is produced between the first conductive and the first coaxial contacts 26 and 27. The space can be utilized in movement of the third connection element (46-55-56) in the predetermined direction 45. Therefore, it is unnecessary to provide a particular space for movement of the third connection element. This means the electrical connector can be made in a small size in a fitting direction, namely, the predetermined direction 45.

When the movable insulator 46 is placed at a lower position of the recessed portion 28 of the first insulator 25 as shown in FIG. 1, the first connecting, the second connecting, and the cylindrical members 55, 56, and 61 are not brought in contact with the second contact portion 36*a*, the second socket portion 44 and second outer conductor 42 in the second connection element 22, respectively. This means the first and the second connection elements 21 and 22 are disconnected from one another.

Figure 6:
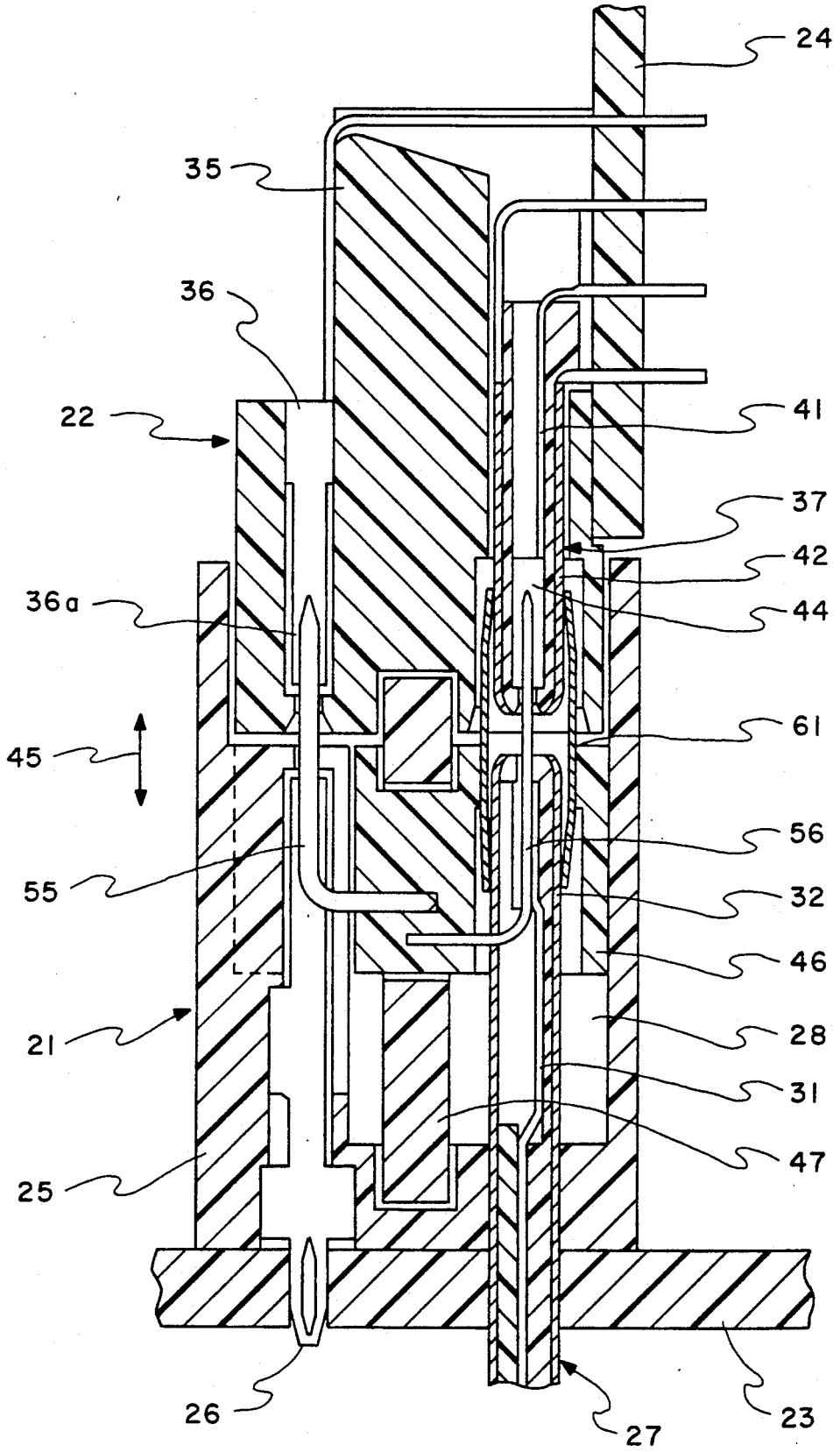
FIG. 6 is a similar sectional view of the electrical connector of FIG. 1, but the movable insulator moved to a connecting portion.

When the slider plate 47 is moved in the particular direction 48, the movable insulator 46 is moved upwardly in the predetermined direction 45, as shown in FIG. 6, with the third portion 54*c* of the slit 54 of the slider plate 47 engaging the cam follower 53 of the movable insulator 46. As a result, the first and the second connecting members 55 and 56 are lifted up to closely fit into the second contact portion 36*a* of the second conductive contact 36 and the second socket portion 44 of the second inner conductor 41, respectively. Simultaneously, the cylindrical member 61 is lifted up to closely fit onto the second outer conductor 42. Accordingly, the first and the second connection elements 21 and 22 are electrically connected to one another.

When the slider plate 47 is moved reversely, the movable insulator 46 is moved downwardly to thereby electrically disconnect between the first and the second connection elements 21 and 22.

Description will be directed to an electrical connector according to a second embodiment of this invention.

Although the electrical connector is for carrying out a plurality of coaxial connections and a plurality of uniaxial connections, the description will be made about one of the coaxial connections and one of uniaxial connections for a better understanding of the present invention.

Figure 7:
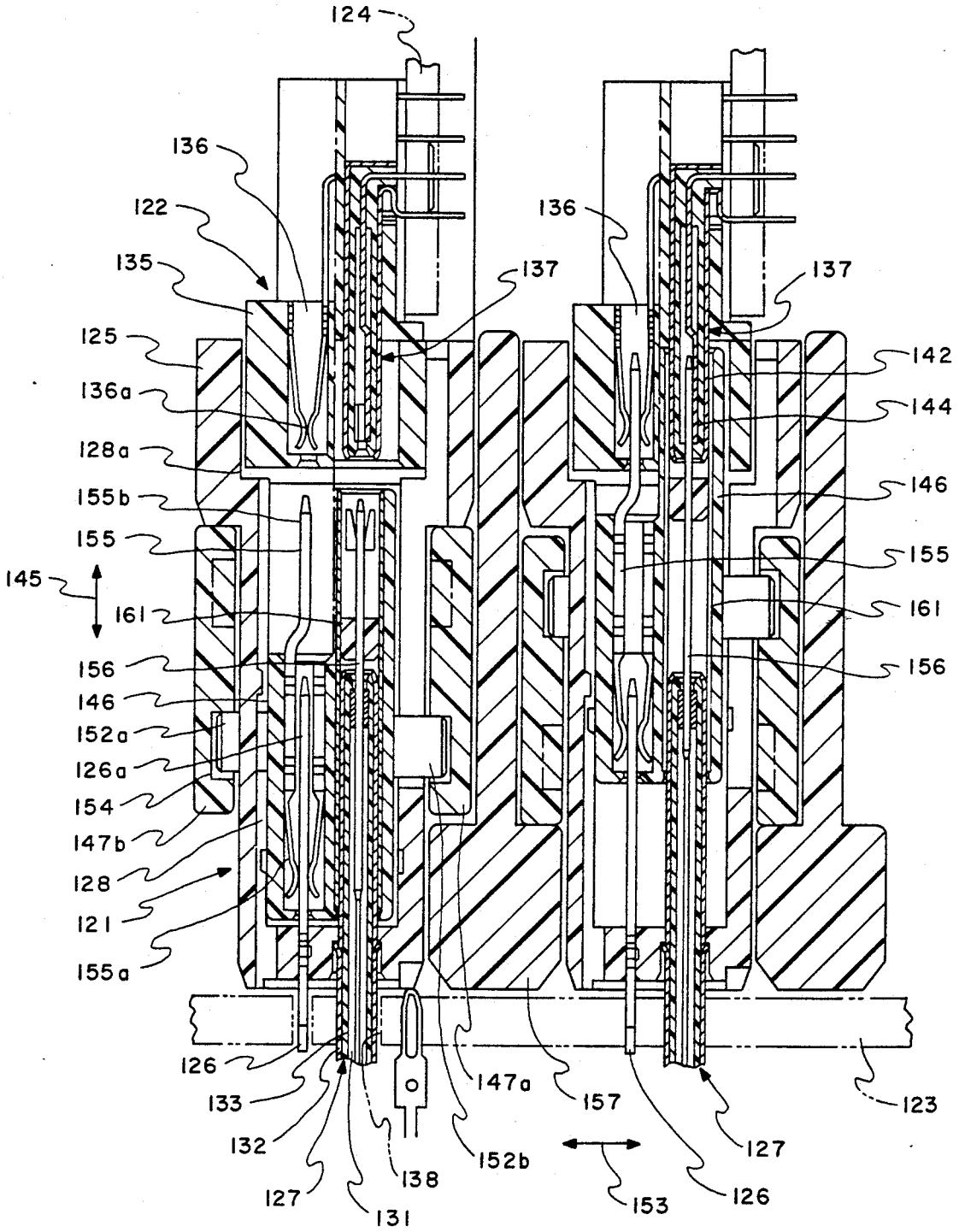
FIG. 7 is a sectional view of an electrical connector according to a second embodiment of this invention.
Figure 8:
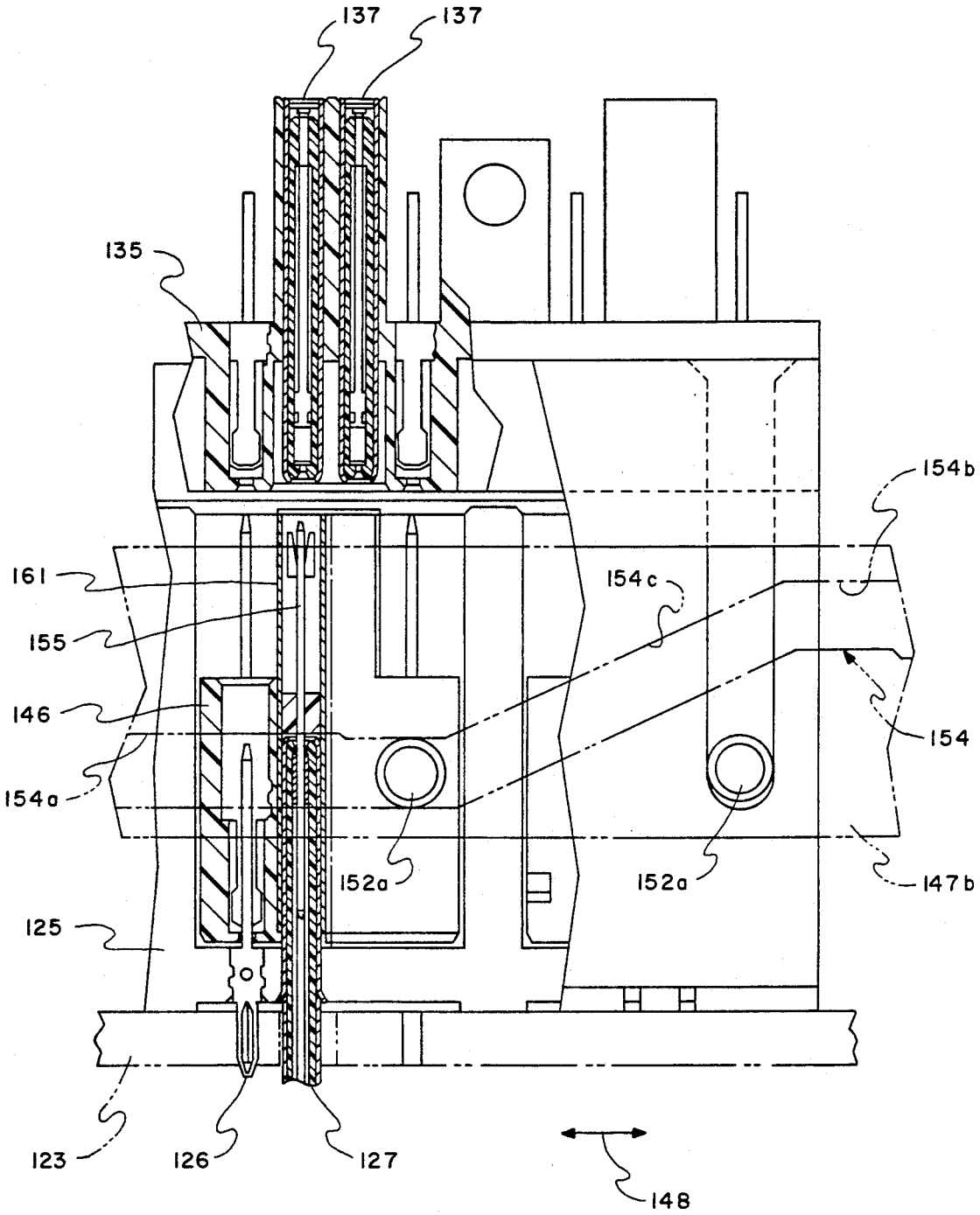
FIG. 8 is a partially sectional left side view of a main part of the electrical connector of FIG. 7.
Figure 9:
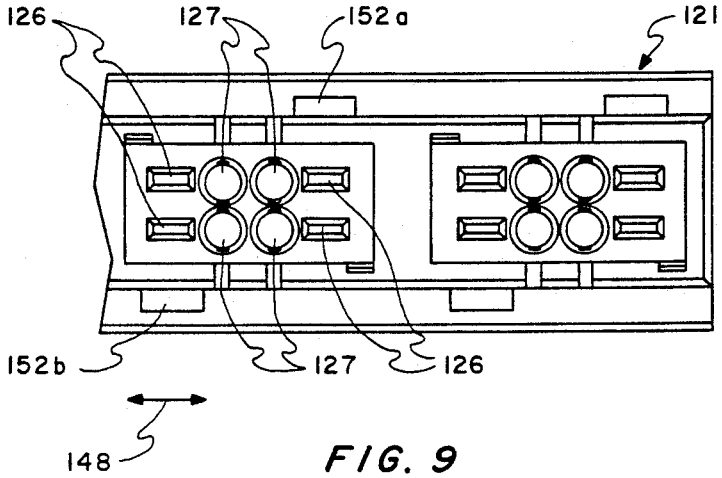
FIG. 9 is a bottom view of a main part of the electrical connector of FIG. 7.

Referring to FIGS. 7 through 9, the electrical connector comprises first and second connection elements 121 and 122. The first connection element 121 is mounted on a circuit board 123 extending along a horizontal plane. The second connection element 122 is mounted on a distributing board 124 extending along a vertical plane which is perpendicular to the horizontal plane. Each of the circuit and the distributing boards 123 and 124 may be a printed circuit board which is known in the art.

Figure 10:
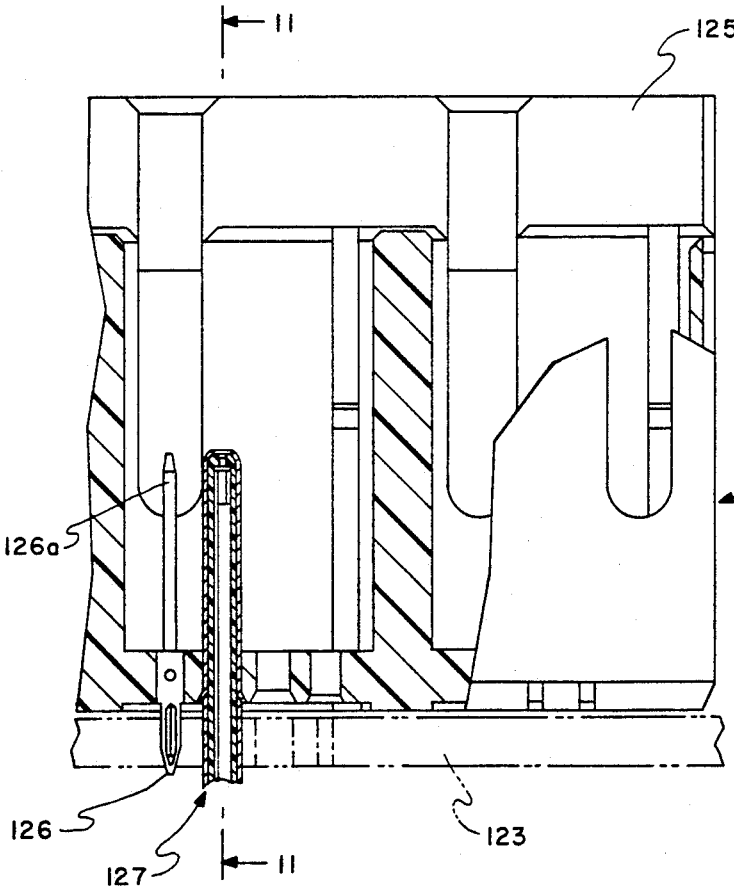
FIG. 10 is a side sectional view of a main part of a first connection element included in the electrical connector of FIG. 7.
Figure 11:
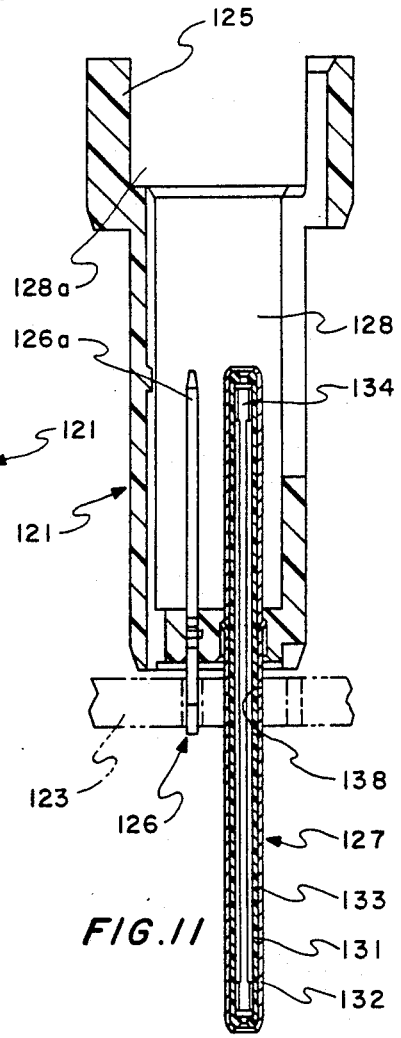
FIG. 11 is a sectional view of the first connection element taken along a line 11—11 in FIG. 10.

The first connection element 121 comprises a first insulator 125, a first conductive contact 126, and a first coaxial contact 127 as will be clear from FIGS. 10 and 11. The first insulator 125 is made with a recessed portion 128 having an opening at an upper end thereof. The first conductive and the first coaxial contacts 126 and 127 are held to the first insulator 125. The first conductive contact 126 is mechanically fixed to the circuit board 123 and is electrically connected to a first electric circuit which is mounted on the circuit board 123. The first conductive contact 126 has a first contact portion 126*a* of a pin type at an upper portion thereof.

The first coaxial contact 127 comprises first inner and first outer conductors 131 and 132 which are insulated from one another by a first internal insulator 133 as best illustrated in FIG. 11. The first inner conductor 131 has a first socket portion 134 and may therefore be referred to herein as a first conductive contact. The first outer conductor 132 is cylindrical. The first inner and the first outer conductors 131 and 132 are led through a through hole 138 formed in the printed circuit board 123 and extends downwardly from the circuit board 123.

The second connection element 122 comprises a second insulator 135, a second conductive contact 136, and a second coaxial contact 137 as will be clear from FIGS. 12 through 15. The second insulator 135 is fitted in an upper part 128*a* of the recessed portion 128 of the first insulator 125. The second conductive and the second coaxial contacts 136 and 137 are held to the second insulator 135. The second conductive contact 136 is mechanically fixed to the distributing board 124 and is electrically connected to a second electric circuit which is mounted on the distributing board 124. The second conductive socket contact 136 has a second contact portion 136*a* of a socket type at a lower portion thereof.

Figure 12:
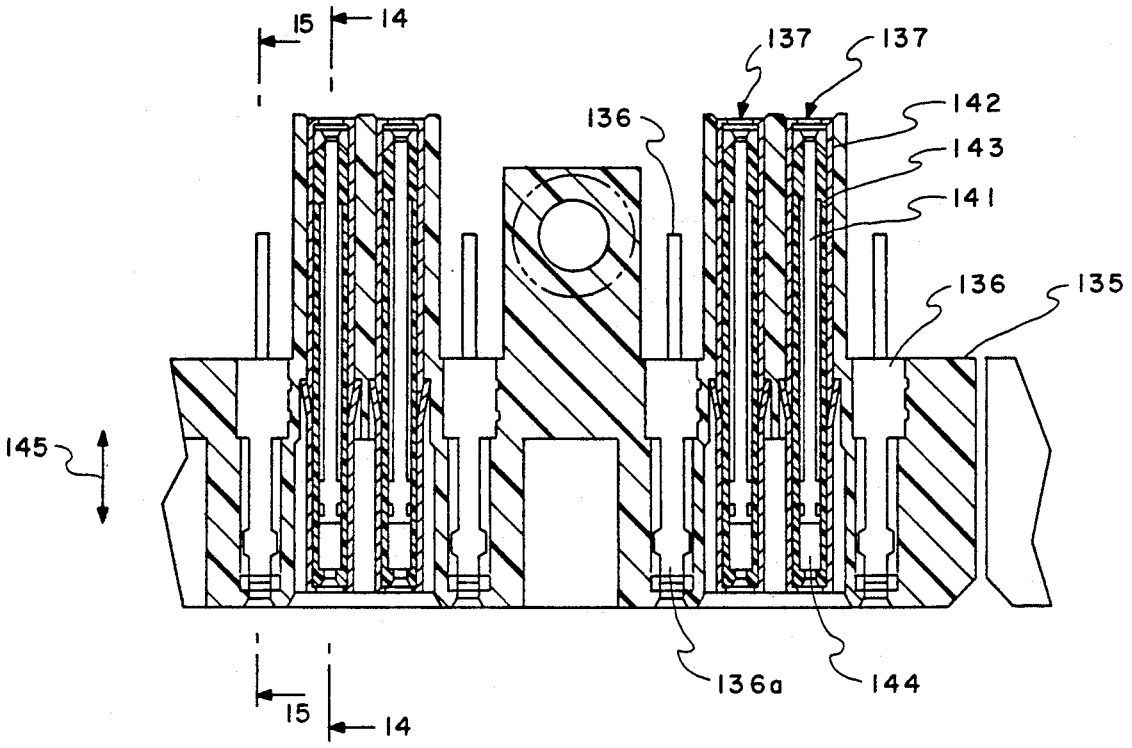
FIG. 12 is a side sectional view of a main part of a second connection element included in the electrical connector of FIG. 7.
Figure 13:
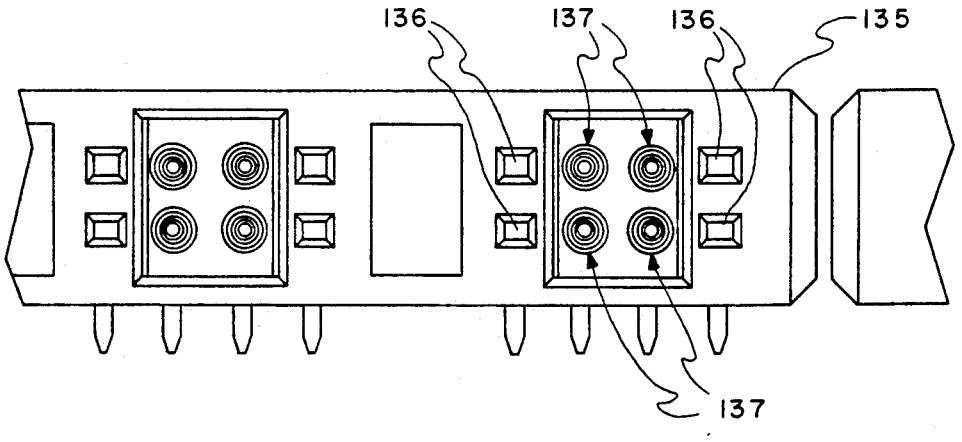
FIG. 13 is a bottom view of the second connection element of FIG. 12.
Figure 14:
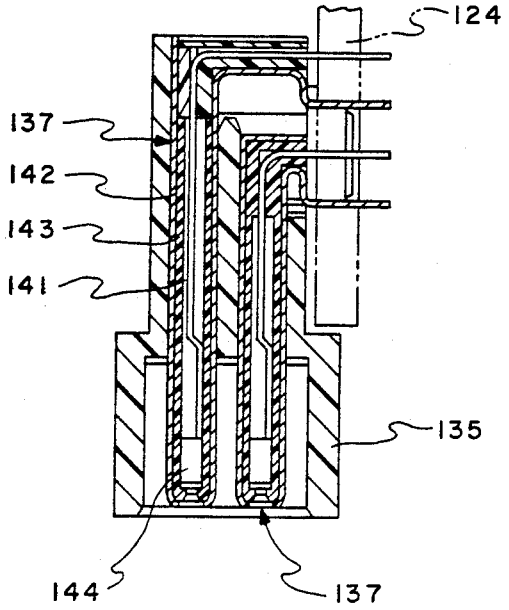
FIG. 14 is a sectional view of the second connection element taken along a line 14—14 in FIG. 12.
Figure 15:
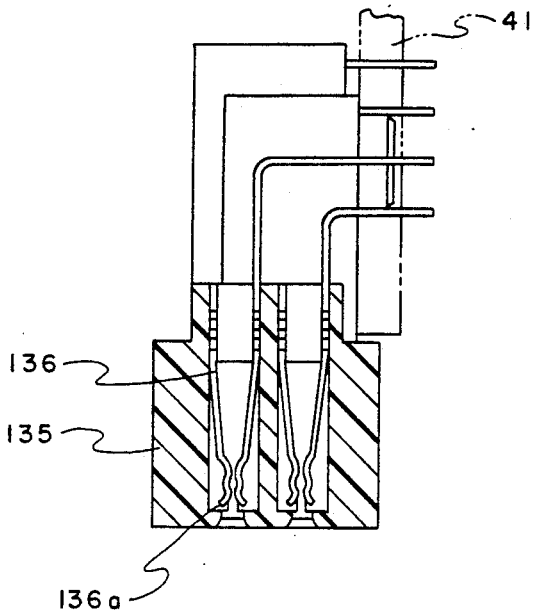
FIG. 15 is a sectional view of the second connection element taken along a line 15—15 in FIG. 12.

The second coaxial contact 137 comprises second inner and second outer conductors 141 and 142 which are insulated from one another by a second internal insulator 143 as clearly understood from FIGS. 12 and 14. The second inner conductor 141 has a second socket portion 144 and may therefore be referred to herein as a second conductive contact. The second outer conductor 142 is cylindrical. The second inner and the second outer conductors 141 and 142 are mechanically fixed to the distributing board 124 and is electrically connected to the second electric circuit.

The first and the second conductive contacts 126 and 136 are placed to have a first common axis extending in the predetermined direction 145. In other words, the first contact portion 126*a* of the first conductive contact 126 faces the second contact portion 136*a* of the second conductive contact 136 in a predetermined direction 145.

The first and the second coaxial contacts 127 and 137 are placed to have a second common axis extending in the predetermined direction 145. In other words, the first socket portion 134 of the first inner conductor 131 faces the second socket portion 144 of the second inner conductor 141 in the predetermined direction.

Figure 16:
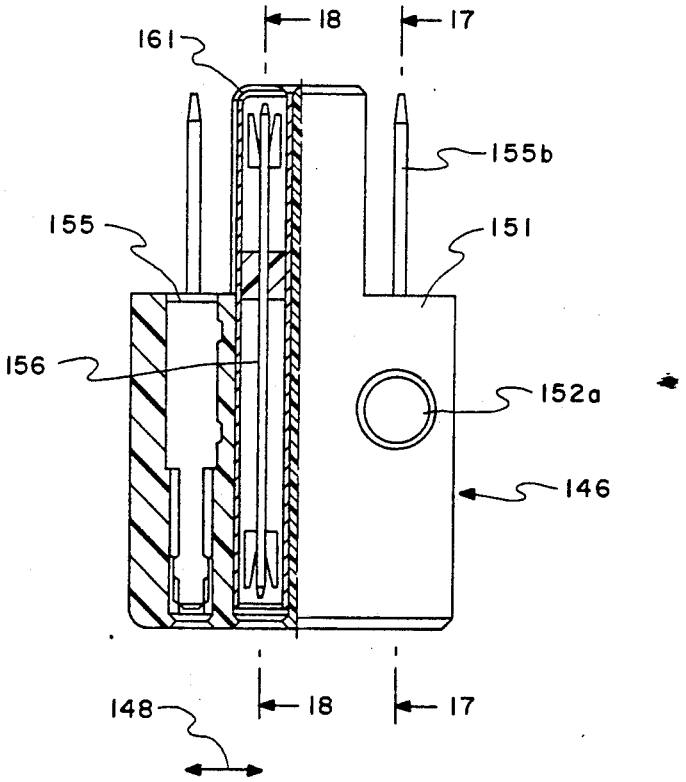
FIG. 16 is a half-sectional view of a third connection element.
Figure 17:
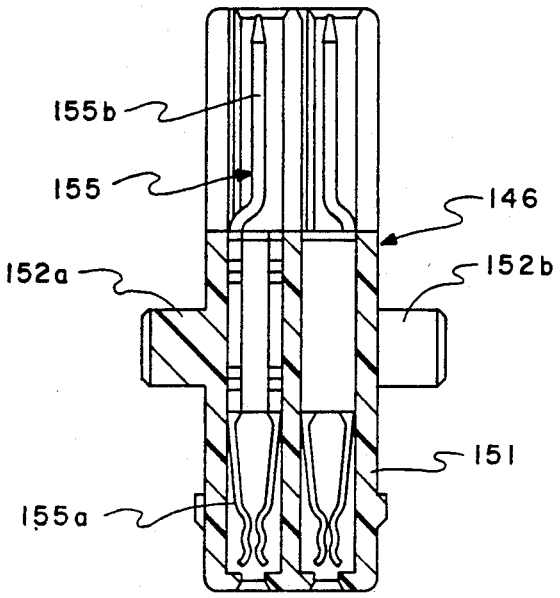
FIG. 17 is a sectional view of the third connection element taken along a line 17—17 in FIG. 16.
Figure 18:
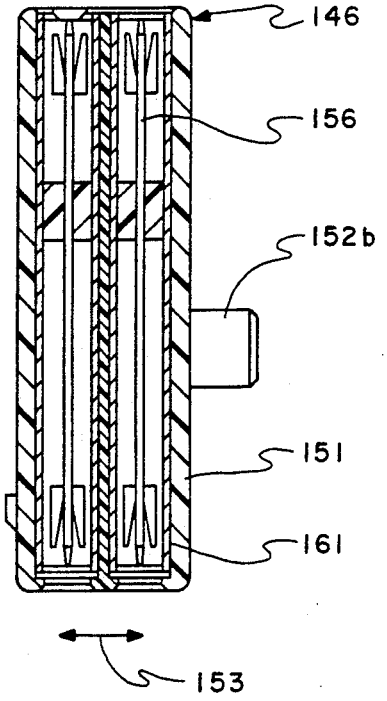
FIG. 18 is a sectional view of the third connection element taken along a line 18—18 in FIG. 16.

A movable insulator 146 is placed in the recessed portion 128 of the first insulator 125. The movable insulator 146 is movable in the predetermined direction 145 and comprises an insulation body 151 and a pair of projections 152*a* and 152*b* as will be clear from FIGS. 16 through 18. The insulation body 151 has end surfaces opposite to each other in a specific direction 153 which is perpendicular to the predetermined and the particular directions 145 and 148. The projections 152*a* and 152*b* project from the end surfaces of the insulation body 151 in the specific direction 153, respectively. In addition, the projections 152*a* and 152*b* are placed different from one another in the particular direction 148 as best shown in FIG. 9.

The electrical connector further comprises two slider plates 147*a* and 147*b* coupled to the first and the movable insulators 125 and 146. The slider plates 147*a* and 147*b* are fixed to each other by structure which is not illustrated in the figure. The slider plates 147*a* and 147*b* are movable in a particular direction 148 which is perpendicular to the predetermined direction 145. Each of the slider plates 147*a* and 147*b* has cam surfaces defining a groove 154 therebetween for receiving each of the projections 152*a* and 152*b* and is guided in the particular direction 148 by the first insulator 125 and a third insulator 157 as a stiffening member. The groove 154 has first and second portions 154*a* and 154*b* extending in the particular direction 148 but offset to each other, and a third or an offset portion 154*c* extending slantingly to connect the first portion 154*a* with the second portion 154*b*. It is to be noted in this connection that the third portion 154c of the groove 154 of one of the slider plates 147a and 147b is placed different from that of another one of the slider plates 147a and 147b in the particular direction 148 as well as positions of the projections 152a and 152b.

Referring to FIGS. 7 and 9 again, first and second connecting members 155 and 156 are held to the movable insulator 146. The first connecting member 155 extends in the predetermined direction 145 and comprises a socket and a pin contact portion 155a and 155b at ends thereof. The socket contact portion 155a is closely fitted on the first contact portion 126a of the first conductive contact 126. The pin contact portion 155b is adapted to closely fit in the second contact portion 136a of the second conductive contact 136.

The second connecting member 156 is of a pin type and comprises a portion being in contact with the first socket portion 134 of the first inner conductor 131 inside the first outer conductor 132.

The second connecting member 156 extends in the predetermined direction 145 through the first socket portion 134 and is adapted to closely fit in the second socket portion 144 of the second inner conductor 141. A combination of the movable insulator 146, the first connecting member 155, and the second connecting member 156 will be referred to herein as a third connection element.

In addition, the movable insulator 146 holds a cylindrical member 161 which is closely fitted on the first outer conductor 132. The cylindrical member 161 is of a conductive material and is adapted to closely fit on the second outer conductor 142 as will later be clear. The cylindrical member 161 is referred to as an additional connecting member.

According to this construction, a space is produced between the first conductive and the first coaxial contacts 126 and 127. The space can be utilized in movement of the third connection element (146-155-156) in the predetermined direction 145. Therefore, it is unnecessary to provide a particular space for movement of the third connection element. This means the electrical connector can be made in a small size in a fitting direction, namely, the predetermined direction 145.

When the movable insulator 146 is placed at a lower position of the recessed portion 128 of the first insulator 125 as shown leftwardly of FIG. 7, the first connecting, the second connecting, and the cylindrical members 155, 156, and 161 are not brought in contact with second contact portion 136a, the second socket portion 144a, and the second outer conductor 142 in the second connection element 122, respectively. This means the first and the second connection elements 121 and 122 are disconnected from one another.

When the slider plates 147a and 147b are moved in the particular direction 148, the movable insulator 146 is moved upwardly in the predetermined direction 145, as shown on the right side in FIG. 7, with the third portion 154c of the slit 154 of each of the slider plates 147a and 147b engaging the projections 152a and 152b of the movable insulator 146. As a result, the first and the second connecting members 155 and 156 are lifted up to closely fit into the second contact portion 136a of the second conductive contact 136 and the second socket portion 144 of the second inner conductor 141, respectively. Simultaneously, the cylindrical member 161 is lifted up to closely fit onto the second outer conductor 142. Accordingly, the first and the second connection elements 121 and 122 are electrically connected to one another.

When the slider plates 147a and 147b are moved reversely, the movable insulator 146 is moved downwardly to thereby electrically disconnect between the first and the second connection elements 121 and 122.

Figure 19:
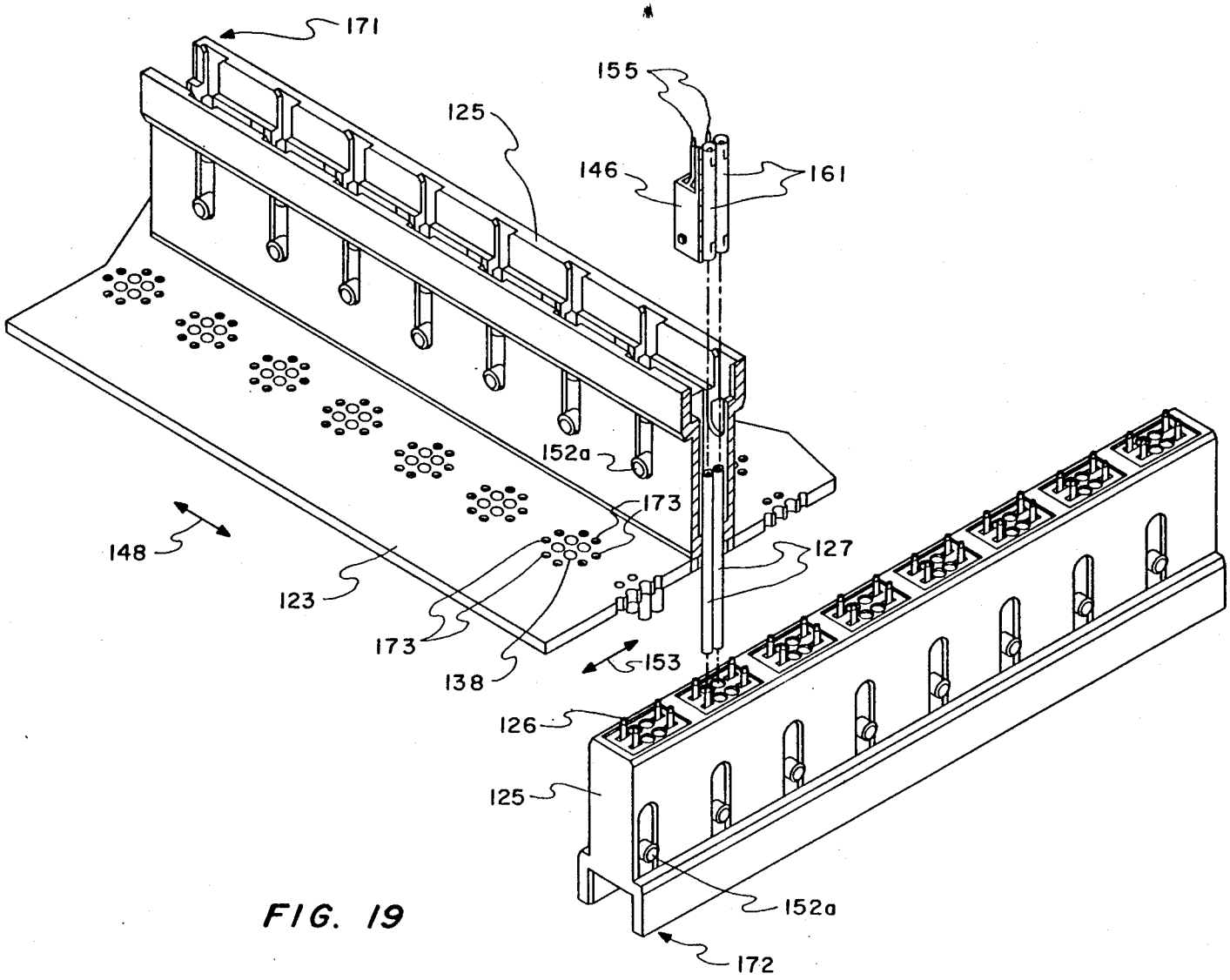
FIG. 19 is a perspective view of a connection unit comprising the electrical connector of FIG. 7.

Referring to FIG. 19 together with FIGS. 7 through 9, description will be made about a connection unit comprising first and second electrical connectors 171 and 172 each of which is similar to the electrical connector illustrated in FIGS. 7 through 9. In FIG. 19, the first and the second electrical connectors 171 and 172 are placed on both sides of the circuit board 123, respectively. It is to be noted in this connection that the first coaxial contact 127 is shared by the first and the second electrical connectors 171 and 172.

The circuit board 123 has eight additional holes 173 arranged around the through holes 138 through each of which the first coaxial contact 127 is inserted. The first conductive contact 126 of the first electrical connector 171 is inserted in each of those ones of the additional holes 173 which are arranged at both sides of the through holes 138 in the particular direction 148. On the other hand, the first conductive contact 126 of the second electrical connector 172 is inserted in each of the remaining additional holes 173.

Figure 20:
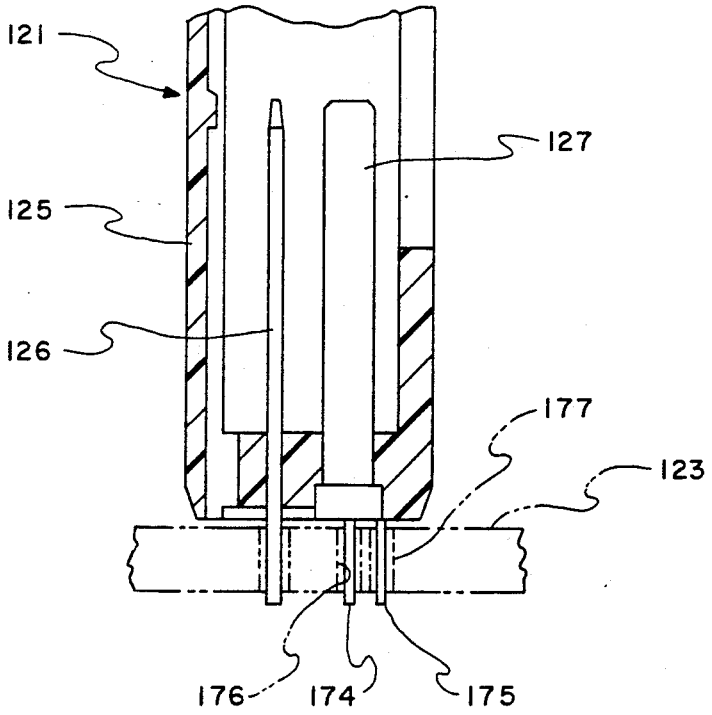
FIG. 20 is a sectional view of a modification of the first connection element of FIG. 10.

While the present invention has thus far been described in connection with only one embodiment thereof, it will readily be possible for those skilled in the art to put this invention into practice in various other manners. As a modification of the first connection element 121 illustrated in FIG. 20, the first coaxial contact 127 may be provided with terminal portions 174 and 175 which are inserted in through holes 176 and 177 of the circuit board 123 to electrically connect the inner and the outer conductors with the circuit board 123.

What is claimed is:

1. An electrical connector comprising:

a first connection element comprising a first conductive contact of a socket type;

a second connection element comprising a second conductive contact of a socket type facing in a predetermined direction toward said first conductive contact;

a third connection element comprising a connecting member of a pin type closely fitted in said first conductive contact, said connecting member being movable in said predetermined direction for electrically connecting said first conductive contact to said second conductive contact with said connecting member closely fitted into said second conductive contact, said third connection element further comprising a movable insulator which is mechanically coupled to said connecting member and which is movable in said predetermined direction; and drive means for driving said movable insulator in said predetermined direction, said drive means being movable in a particular direction which is perpendicular to said predetermined direction for engaging said movable insulator to make said movable insulator move in said predetermined direction when said drive means is moved in said particular direction.

2. An electrical connector comprising:

a first connection element comprising a first conductive contact of a socket type;

a second connection element comprising a second conductive contact of a socket type facing in a predetermined direction toward said first conductive contact and a third connection element comprising a connecting member of a pin type closely fitted in said first conductive contact, said connecting member being movable in said predetermined direction for electrically connecting said first conductive contact to said second conductive contact with said connecting member closely fitted into said second conductive contact, said first connection element further comprising a first cylindrical conductor which has a first central axis extending in said predetermined direction and which is fitted on said first conductive contact with a first gap left therebetween, said second connection element further comprising a second cylindrical conductor which has a second central axis extending in said predetermined direction and which is fitted on said second conductive contact with a second gap left therebetween, said third connection element further comprising an additional connecting member which is in contact with said first cylindrical conductor and which is movable in said predetermined direction for electrically connecting said first cylindrical conductor to said second cylindrical conductor with said additional connecting member brought in contact with said second cylindrical conductor.

3. An electrical connector as claimed in claim 2, wherein said third connection element further comprises a movable insulator which is mechanically coupled to said connecting member and which is movable in said predetermined direction.

4. An electrical connector as claimed in claim 3, further comprising drive means for driving said movable insulator in said predetermined direction.

5. An electrical connector as claimed in claim 4, wherein said drive means is movable in a particular direction perpendicular to said predetermined direction for engaging said movable insulator to make said movable insulator move in said predetermined direction when said drive means is moved in said particular direction.

6. An electrical connector as claimed in claim 2, wherein said additional connecting member comprises a cylindrical member closely fitted on said first cylindrical conductor, said cylindrical member being movable in said predetermined direction for electrically connecting said first cylindrical conductor to said second cylindrical conductor with said cylindrical member closely fitted on said second cylindrical conductor.

7. An electrical connector as claimed in claim 2, wherein said third connection element further comprises a movable insulator which is mechanically coupled to the first-mentioned connecting and said additional connecting members and which is movable in said predetermined direction.

8. An electrical connector as claimed in claim 7, further comprising drive means for driving said movable insulator in said predetermined direction.

9. An electrical connector as claimed in claim 8, wherein said drive means is movable in a particular direction perpendicular to said predetermined direction for engaging said movable insulator to make said movable insulator move in said predetermined direction when said drive means is moved in said particular direction.

10. An electrical connector as claimed in claim 9, wherein said movable insulator comprises:

an insulation body having end surfaces opposite to each other in a specific direction which is perpendicular to said predetermined and said particular directions; and a pair of projections projecting from said end surfaces of the insulation body in said specific direction, respectively;

said drive means comprising:

a pair of slider plates facing said opposite ends of the insulator body, respectively; and coupling means for mechanically coupling said slider plates to each other, each of slider plates having cam means for engaging each of said projections to make said movable insulator be moved in said predetermined direction when said drive means is moved in said particular directions.

11. An electrical connector as claimed in claim 10, wherein said projections are placed different from one another in said particular direction.

12. A combination of a circuit board and a first and a second electrical connector, said circuit board having first and second surfaces which are opposite to each other, said first and said second electrical connectors being placed on said first and said second surfaces, respectively, each of said first and said second electrical connectors comprising:

a first connection element comprising a first conductive contact of a socket type;

a second connection element comprising a second conductive contact of a socket type facing in a predetermined direction toward said first conductive contact; and a third connection element comprising a connecting member of a pin type closely fitted in said first conductive contact, said connecting member being movable in said predetermined direction for electrically connecting said first conductive contact to said second conductive contact with said connecting member closely fitted into said second conductive contact, said first connection element further comprising a first cylindrical conductor which has a first central axis extending in said predetermined direction and which is fitted on said first conductive contact with a first gap left therebetween, said second connection element further comprising a second cylindrical conductor which has a second central axis extending in said predetermined direction and which is fitted on said second conductive contact with a second gap left therebetween, said third connection element further comprising an additional connecting member which is in contact with said first cylindrical conductor and which is movable in said predetermined direction for electrically connecting said first cylindrical conductor to said second cylindrical conductor with said additional connecting member brought in contact with said second cylindrical conductor.

13. A combination as claimed in claim 12, wherein said first electrical connector extends along said first surface of the circuit board in a first direction perpendicular to said predetermined direction, said second electrical connector extending along said second surface of the circuit board in a second direction which is perpendicular to said predetermined and said first directions.

14. A combination as claimed in claim 13, wherein said circuit board has a through hole extending between said first and said second surfaces of the circuit board, said through hole having ends which are opposite to said first and said second electrical connectors, respectively, said combination further comprising:

an additional contact connection element inserted into said through hole for electrically connecting said first conductive contact of the first electrical connector to said first conductive contact of the second electrical connector; and an additional conductor connection element inserted into said through hole for electrically connecting said first cylindrical conductor of the first electrical connector to said first cylindrical conductor of the second electrical member.

15. A combination as claimed in claim 14, wherein said additional contact connection element extends in said predetermined direction, said additional conductor connection element having an element central axis extending in said predetermined direction, said additional conductor connection element being fitted on said additional contact connection element with an additional gap left therebetween.

* * * * *